US005840247A

United States Patent [19]

Dubois et al.

[11] Patent Number: 5,840,247

[45] Date of Patent: Nov. 24, 1998

[54] PROCESS FOR THE PROTECTION OF ACTIVE REINFORCEMENTS EMBEDDED IN A CONCRETE MASS

[76] Inventors: Pierre-Marie Dubois, Rue les Culots, 37, Ophain-Bois-Seigneur-Isaac, Belgium, B-1421; Daniel Michaux, 15 Allee Courbet, Livry Gargan, France, F-93190

[21] Appl. No.: 709,678

[22] Filed: Sep. 9, 1996

[51] Int. Cl.[6] ..... C23F 11/00

[52] U.S. Cl. ..... 422/7; 427/403; 427/140; 52/223.1; 52/514; 106/14.05

[58] Field of Search ..... 52/223.1, 514; 422/7; 427/403, 140; 106/14.05

[56] References Cited

U.S. PATENT DOCUMENTS 2,346,879 4/1944 Turzillo ..... 72/128

FOREIGN PATENT DOCUMENTS 0300956 1/1989 European Pat. Off. .

2116618 7/1972 France .

1480718 7/1977 United Kingdom .

WO92/20902 11/1992 WIPO .

*Primary Examiner*—Stephen Walsh

*Assistant Examiner*—Eliane Lazar-Wesley

*Attorney, Agent, or Firm*—Jacobson, Price, Holman & Stern, PLLC

[57] ABSTRACT

The invention provides a process for the protection of active reinforcements embedded in a concrete mass against the effects of oxidation, said reinforcements being possibly in the form of a bunch of cables or strands arranged in a sheath, providing also the possibility to detect imperfections of the injection grout such as voids or porosity, wherein at least one channel is first drilled in the concrete mass opening in front of the reinforcements which have to be protected, whereafter a corrosion inhibiting solution is injected into the said channel while applying a high power pulsating wave to the said solution to make it penetrate and each channel is occluded.

7 Claims, 2 Drawing Sheets

PROCESS FOR THE PROTECTION OF ACTIVE REINFORCEMENTS EMBEDDED IN A CONCRETE MASS

FIELD OF THE INVENTION

The invention relates to a process for the protection of active reinforcements embedded in a concrete mass against the effects of oxidation, possibly being reinforcements in the form of a bunch of wires or strands arranged in a sheath, and also at the same time for detecting imperfections of the injection grout, such as voids, porosity, etc.

Although the invention applies to the protection of every type of reinforcement in a concrete mass, the invention is directed more precisely and shall be described more particularly within the context of protection against the effects of oxidation of reinforcements or of a reinforcement group such as that which is found in civil engineering structures built in accordance with techniques called prestressed or post-tensioned.

BACKGROUND OF THE INVENTION

By prestressed or post-tensioned concrete is meant a technology enabling beams, slabs or every concrete component to be given enough specific strength to allow them to fulfil the function which was assigned to them.

This specific strength is provided by tensioning either wires, strands or even steel bars having a very high tensile strength limit, generally called active reinforcements. The tensile load applied to tension these reinforcements is transferred to the concrete which, by reaction, undergoes the effect of compression. The normal stresses and bending moments caused in this way equilibrate the action of external loads, in this way providing the strength required.

The active reinforcements are made of high resistance steel especially sensitive to deterioration through the effect of corrosion due to the action of oxygen. Protection against corrosion of these reinforcements is conventionally provided by covering them with mortar or cement grout. In the latter case, the active reinforcements are enveloped in a continuous sheath, most frequently made of steel strips but also of PVC or, more recently, of high density polyethylene. This sheath comprises a conduit which enables cement protecting grout to be injected. The protection due to adherence of the active prestressing reinforcements is that imparted by the structural concrete.

In principle, this protection against corrosion should be sufficient because it provides a barrier against the penetration of the oxygen of the air, it provides waterproofing and in addition it imparts to the surroundings a basic pH preventing the development of corrosion.

A great many factors among which injection faults or quite simply, the inevitable physical phenomenon of shrinkage of mortars or cement grouts are responsible for inadequate or incomplete protection. Even when protection is ensured to a high percentage, the low percentage of incompleteness is easily enough to cause corrosion by oxygenation of the active reinforcements.

These protection defects, even confined and sheltered from air renewal, sooner or later pose corrosion problems.

The struggle against road frosts, black ice and snow being frequently fought by spreading calcium chloride or sodium chloride, sometimes in very significant quantities, chloride contamination can reach the active reinforcements, owing to defects in the surrounding cover. Physico-chemical conditions favorable to corrosion can easily become such that corrosion develops, causing failure of the reinforcements in extreme cases.

The described "pathology" relates to highway bridges as well as to every kind of prestressed or post-tensioned construction.

Another source of corrosion of active steel components consists of the lose of the highly basic character of the environment surrounding the steel components (mortar, cement grout, concrete) an account of the action of carbon dioxide on this environment making it more susceptible to oxidation.

SUMMARY OF THE INVENTION

The purpose of the invention is to propose a new process, capable of correcting or mending the effects of oxidation on active reinforcements, this term being taken in its widest sense.

More precisely, the invention therefore consists of making a corrosion inhibiting solution penetrate on the whole of the metal elements present, even with units properly grouted with cement.

PREFERRED EMBODIMENTS OF THE INVENTION

To achieve this objective in conformity with the invention, a process is provided wherein at least one channel is first drilled in the concrete mass opening in front of the reinforcement which has to be protected, whereafter a corrosion inhibiting solution is injected into the said channel, a high power pulsating wave being applied to said solution in order to make it penetrate.

In one particular embodiment of the invention, when the active reinforcement is surrounded by a sheath as used in prestressing or post-tensioning, the aforementioned channel is drilled also through the said sheath in such a way that the corrosion inhibiting solution can come into contact with the reinforcement, i.e. the bunch of wires or strands to be protected, the corrosion inhibiting solution is injected in the same manner, the cement grout being afterwards injected in order to fill the pores and the voids of the sheaths.

Still in accordance with the invention at least a second channel is drilled opening in front of the reinforcement to be protected in order to monitor the flowage of the inhibiting solution inside the aforementioned sheath and along the said reinforcement.

An outstanding feature of the invention lies in the fact that the inhibiting solution is introduced under pressure by making use of a high frequency alternating pump capable of producing a pulsating effect on the inhibiting solution.

Other details and advantages of the invention will become apparent from the description which will follow hereafter. This description is only provided by way of an example and does not limit the invention. Same reference numerals as used in the attached figures refer to identical or equivalent elements in the various figures.

DETAILED DESCRIPTION OF THE PREFERRED EMBODIMENTS OF THE INVENTION

The process illustrated by these figures is characterized by several successive stages which shall be described hereafter.

Figure 2:
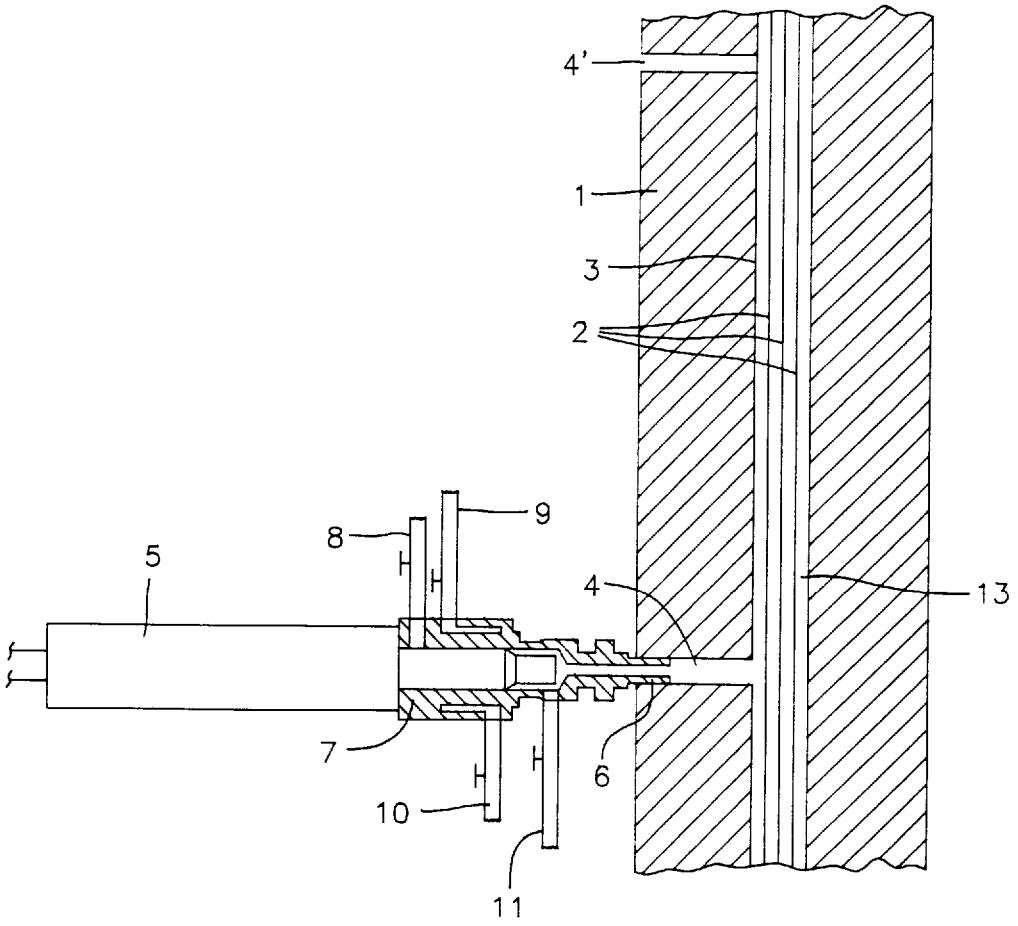
FIGS. 2 and 3 show, at a larger scale, a detail of the installation in accordance with FIG. 1, suitable for the protection of a reinforcement protected by a sheath.
Figure 3:
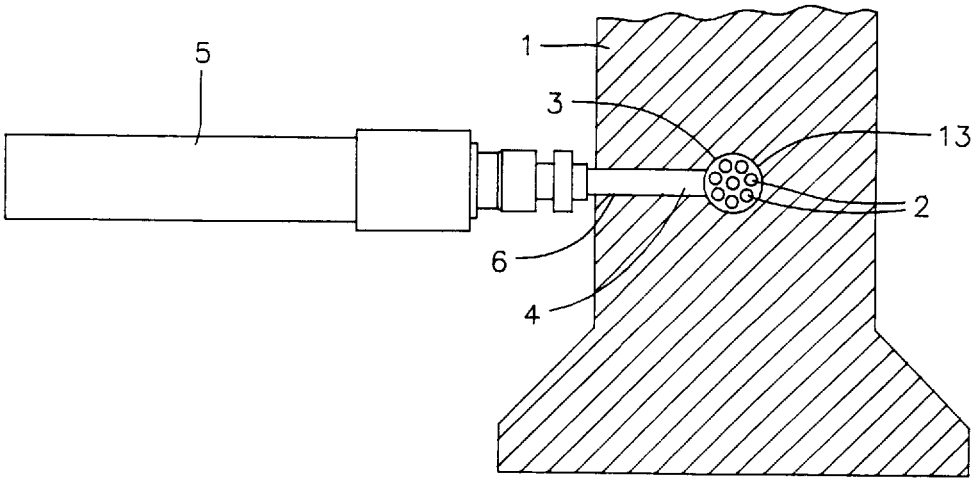

In the figures, reference 1 refers to a prestressed concrete beam. The reinforcements 2 to be protected against the effects of oxidation can be arranged in a sheath which has not been explicitly represented in FIG. 1. In FIGS. 2 and 3, this sheath can be seen and is referred to by reference 3, and a cement grout covers the reinforcements 2.

In a first stage, at least one channel 4 and preferably several channels are drilled in the concrete mass up to the immediate proximity of the reinforcements 2 and, when there is a sheath there, this drilling is also done through this sheath 3.

A corrosion inhibiting solution similar to those well-known in the art, to which a high power pulse generating field is applied, is injected into the channel 4 drilled in this way.

This can be done by making use of a high power ultrasonic transmitter such as an alternating pulse generating pump.

An ultrasonic transmitter specially suitable for application of the process in accordance with the invention is known under the name "Sonotrode®" manufactured and marketed by the SCP BISCORKET company.

A high frequency alternating pulse generating pump suitable for application of the process in accordance with the invention is shown diagrammatically in the various figures under reference 5. Such a pump was developed in such a way that a waterproof chamber is formed allowing the corrosion inhibiting solution to be put under alternating compression. The device, enables the inhibiting solution to be put under overpressure and under vacuum and that at a frequency high enough to obtain a pulse generating effect on the liquid. This pulse generating effect on the liquid facilitates its penetration into the interstices and hairline cracks or micro-fissures in the concrete in the vicinity of the reinforcements to be protected. The ultrasonic transmitter has an injection pipe 6 fitted on the outside with the means enabling absolute waterproofing to be achieved for the channel 4 through which the liquid is injected. In FIG. 2 the compression chamber has reference 7. The inhibiting solution penetrates the ultrasonic transmitter through the conduit 8, while a cooling liquid from the compression chamber reaches the transmitter through conduit 9. The cooling solution from the compression chamber leaves the ultrasonic transmitter through conduit 10 and the corrosion inhibiting liquid through conduit 11 towards the overflow tank 12. The circulation of a cooling liquid is used to prevent overheating and possible deterioration of the corrosion inhibiting liquid.

Ultrasounds created by the high power ultrasonic transmitter of which use is made within the context of the process in accordance with the invention have an additional effect. In fact, the ultrasonic waves generated by the ultrasonic transmitter are powerful enough to create a cavitation effect in the liquid. This cavitation effect enables the inlets leading to the interstices and the hairline cracks or micro-fissures in the concrete to be cleared. Moreover, the ultrasonic acoustic waves cause a vibration inside these interstices and these hairline cracks and due to this effect allow them to be opened and closed at the frequency of the acoustic wave. This phenomenon facilitates the progress of the liquid into these interstices and hairline cracks.

Figure 1:
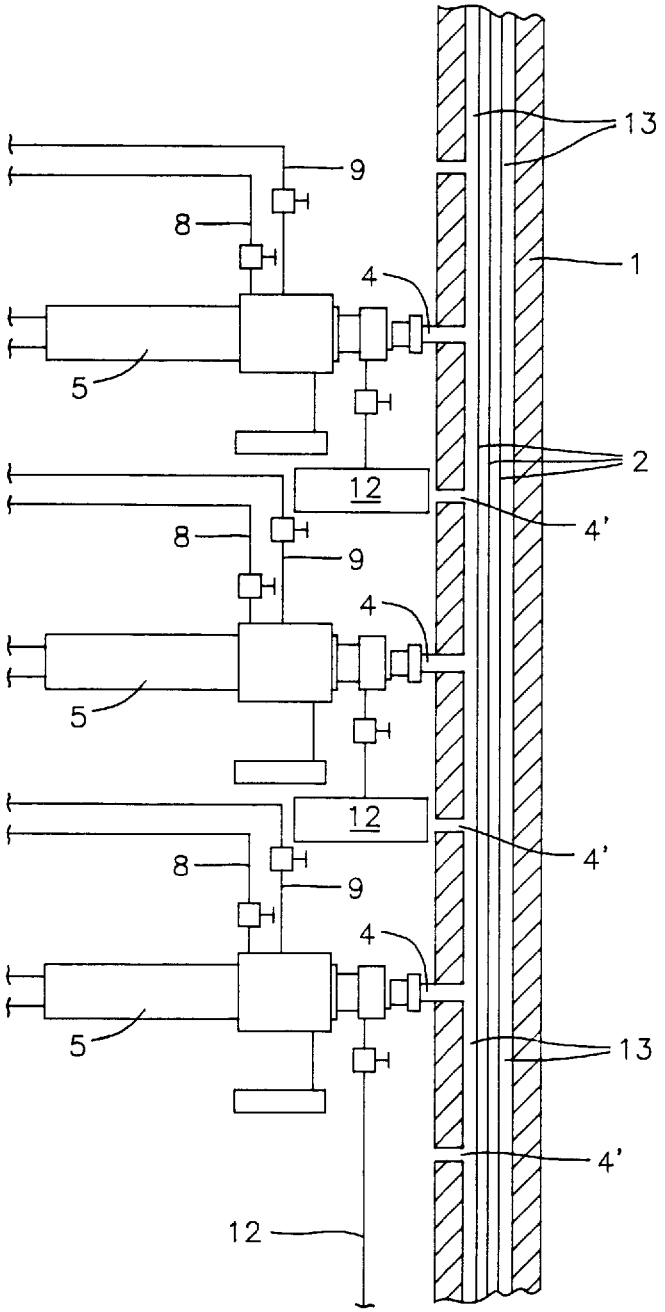
FIG. 1 is a diagrammatic view of an installation showing the process in accordance with the invention.

Within the context of the process in accordance with the invention, as it is shown in FIG. 1, it is to be noted that beside the channels 4 intended for injection of the corrosion inhibiting liquid a series of secondary channels 4' has been also provided. These channels 4' also cross the sheath inside which the reinforcements are arranged.

The channels 4' allow the flowage of the inhibiting solution along the reinforcements 2, respectively inside the sheath 3, to be controlled.

Due to this arrangement it is possible to control continually the proper working of the process by monitoring the flowage of the inhibiting solution inside the concrete.

The process therefore allows the porosity of the mass 13 of the existing injection mortar to be evaluated. If it appears that the said grout is either nonexistent, or very porous, it is possible, after injection of the inhibiting solution, to inject a micromortar based on cement through the channels 4 and that by conventional means or by the process which have been described.

Finally, of course, all the channels 4 and 4' will be occluded after completion of the various operations which have been described.

The invention is clearly not limited to the method of construction described above and many changes could be made to it inasmuch as these fall within the context of the attached claims.

We claim:

1. A process for the protection of active reinforcements embedded in a concrete mass against the effects of oxidation, capable of detecting imperfections resulting from injection grout, comprising: drilling at least one channel in the concrete mass to provide an opening in front of the active reinforcements; and thereafter injecting a corrosion inhibiting solution into said channel while applying a high power pulsating wave to said solution to make it penetrate such that at least each channel is occluded;

said high power pulsating wave being generated by a high power ultrasonic power transmitter with a high enough frequency to produce a pulsating effect on said solution, and to place said solution under pressure.

2. The process as claimed in claim 1, wherein said channel is further drilled through a sheath surrounding the active reinforcements in order to allow the corrosion inhibiting solution to come into contact with the reinforcement to be protected.

3. The process as claimed in claim 1, wherein at least a second channel is drilled to provide an opening in front of the reinforcement to be protected in order to monitor the flowage of the inhibiting solution inside a sheath surrounding said reinforcement and along said reinforcement.

4. The process as claimed in claim 1, wherein cement grout is injected to fill voids in a sheath surrounding said reinforcement when the injection of corrosion inhibiting solution has been completed.

5. The process as claimed in claim 1, wherein a pipe solidly fixed either to the side of said channel or to a sheath surrounding said reinforcements is inserted into said channel said pipe being for injecting the inhibiting solution.

6. The process of claim 1, wherein applying said wave to said solution occludes micro-fissures, micro-cracks and the likes present in the concrete mass.

7. A process for penetrating micro-fissures, micro-cracks and the likes in a concrete mass having reinforcements, said micro-fissures and micro-cracks and the likes being present in both a faulty and non-faulty concrete mass comprising: drilling at least one channel in the concrete mass in front of the reinforcements and thereafter injecting a corrosion inhibiting solution into the channel while simultaneously applying high power pulsating waves with a high power ultrasonic transmitter such that the micro-fissures and micro-cracks vibrate, opening and closing so as to allow penetration of the corrosion inhibiting solution thereinto.

* * * * *